United States Patent [19]

Castellari

[11] Patent Number: 4,920,943

[45] Date of Patent: May 1, 1990

[54] COVER FOR THE VALVE ROCKER COMPARTMENT OF INTERNAL COMBUSTION ENGINES, WITH A LUBRICATING OIL ANTI-SUCKING DEVICE

[75] Inventor: Angelo Castellari, Reggio Emilia, Italy

[73] Assignee: Lombardini Fabbrica Italiana Motori S.p.A., Reggio Emilia, Italy

[21] Appl. No.: 349,638

[22] Filed: May 10, 1989

[30] Foreign Application Priority Data

May 13, 1988 [IT] Italy ..... 46847 A/88

[51] Int. Cl.[5] ..... F02B 25/06

[52] U.S. Cl. ..... 123/572; 123/574

[58] Field of Search ..... 123/572, 574

[56] References Cited

U.S. PATENT DOCUMENTS

| | | | |
|---|---|---|---|
| 3,123,060 | 3/1964 | Daigh | 123/572 |
| 3,839,996 | 10/1974 | DeBiasse | 123/572 |
| 4,345,573 | 8/1982 | Obata | 123/572 |
| 4,603,673 | 8/1986 | Hiraoka et al. | 123/572 |
| 4,607,604 | 8/1986 | Kanoh et al. | 123/572 |
| 4,686,946 | 8/1987 | Umeda et al. | 123/572 |
| 4,760,833 | 8/1988 | Tatyrek | 123/574 |

*Primary Examiner*—Charles J. Myhre
*Assistant Examiner*—Weilun Lo
*Attorney, Agent, or Firm*—Birch, Stewart, Kolasch & Birch

[57] ABSTRACT

A cover for a valve rocker compartment of an internal combustion engine which comprises a hollow shaped casing (9) for closing the compartment containing the rockers (6) which operate the engine intake and exhaust valves (22; 33), and a duct system which connects the shaped casing to the engine air intake manifold (2). The duct system is intercepted by a valving member (31) which is maintained in the open positiion by an elastic member of predetermined load, but closes said duct system when the vacuum in the manifold reaches an undesirable value.

4 Claims, 2 Drawing Sheets

COVER FOR THE VALVE ROCKER COMPARTMENT OF INTERNAL COMBUSTION ENGINES, WITH A LUBRICATING OIL ANTI-SUCKING DEVICE

BACKGROUND AND SUMMARY OF THE INVENTION

The present invention relates to improvements in the cover for a valve rocker compartment of internal combustion engines, in general. As is well known, in internal combustion engines the rockers which open and close the intake and exhaust valves are located on the cylinder head in a compartment closed by a cover, which is fixed in a sealed manner onto the cylinder head. The space between the cylinder head and cover is connected to the engine crankcase by way of an aperture through which the rocker operating rods pass, so that the vapor generated when the lubricating oil contained in the crankcase increases in temperature seeps into the compartment to place it under a slight pressure.

To prevent overpressure in the compartment containing the valve rockers, its cover either comprises an outwardly directed vent or, to prevent pollution, is connected by a tube to the air filter.

Whether this connection is made upstream or downstream of the filter cartridge, it creates difficulties. In this respect, in the first case said vapor causes early clogging of the filter elements in the air filter. In the second case, if a large negative pressure arises in the intake manifold due to clogging of the air filter, it is transmitted to the compartment containing the value rockers with the result that the lubricating oil can be drawn up from the crankcase and sucked into the engine cylinder (or cylinders), thus feeding the combustion and progressively drying the sump, resulting in danger to persons and damage to the engine.

The main object of the present invention is to provide an arrangement which obviates the aforesaid problems within the context of a simple, reliable and low-cost construction.

According to the present invention, the proposed cover comprises a duct system which extends from the valve spring retainer to the engine intake manifold and contains a valving member arranged to close said duct system only when the vacuum in the manifold reaches undesirable values for any reason, for example because of clogging of the air filter.

This can be achieved for example by elastic means having a predetermined preload i.e. able to retain the valving member in its open position with a force which is able to oppose the suction action due to the usual range of vacuum in the manifold.

In other words, the valving member is insensitive to the vacuum which is produced by normal air intake conditions, whereas said valving member closes said duct system when the vacuum increases and approaches the limiting value which would result in oil being drawn up from the engine crankcase.

These and further merits and characteristics of the present invention will be more apparent from the detailed description give hereinafter with reference to the accompanying figures which illustrate a preferred embodiment thereof by way of non-limiting example only.

DETAILED DESCRIPTION OF THE INVENTION

Figure 1:
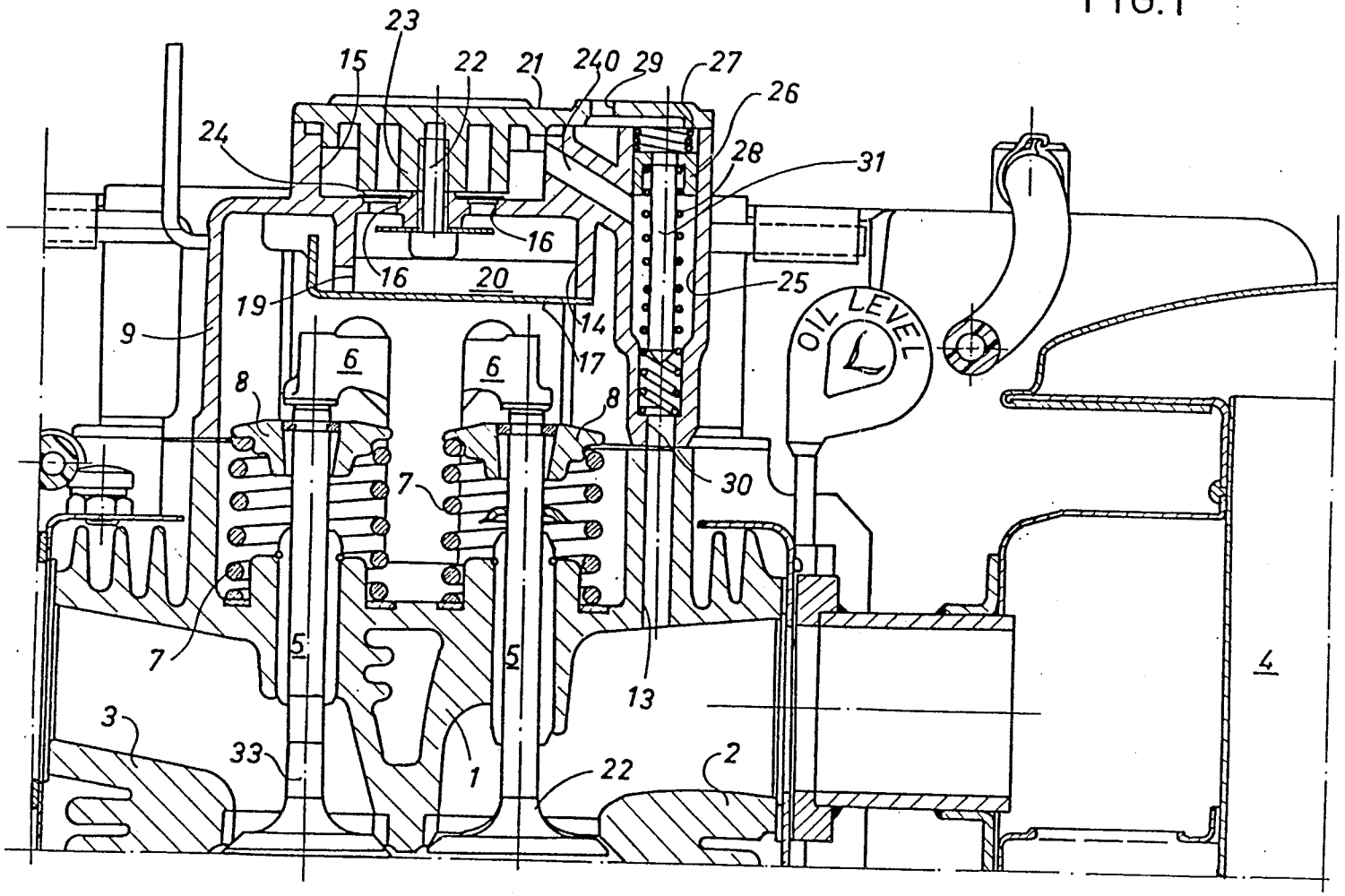
FIG. 1 shows the invention associated with a single-cylinder engine, in a sectional view taken along line I-I FIG. 2.

The figures, and in particular FIG. 1, show the cylinder head 1 of an engine block, which in the illustrated case is of the single-cylinder type. This is in no way to be considered a limiting factor as the characteristic elements of the present are suitable for any type of single or multi-cylinder internal combustion engine of the diesel or otto cycle with its cylinders either in line or not in line. In said cylinder head 1 there are provided an intake duct 2 and an exhaust duct 3, the former connected to a usual air filter 4 (of which only part is shown), and the latter connected to an exhaust pipe (not shown). As is usual, the two ducts 2 and 3 open into the corresponding explosion chamber by way of suitable valves 22 and 33, namely the intake valve and exhaust valve respectively.

In addition, the valve stems 5 emerge from the cylinder head 1 to rest against respective rockers 6, with contact between said stems 5 and rockers 6 being ensured by compression springs 7 lying between the cylinder head 1 and respective valve spring retainers 8 associated with said stems 5 (FIG. 1). Again, although not shown, it should be noted that the opposing ends of the rockers are subjected to the action of push rods which extend towards the engine crankcase where the corresponding camshaft is located.

No further cylinder had constructional details will be described as these are of the usual type well known to experts of the art.

Figure 2:
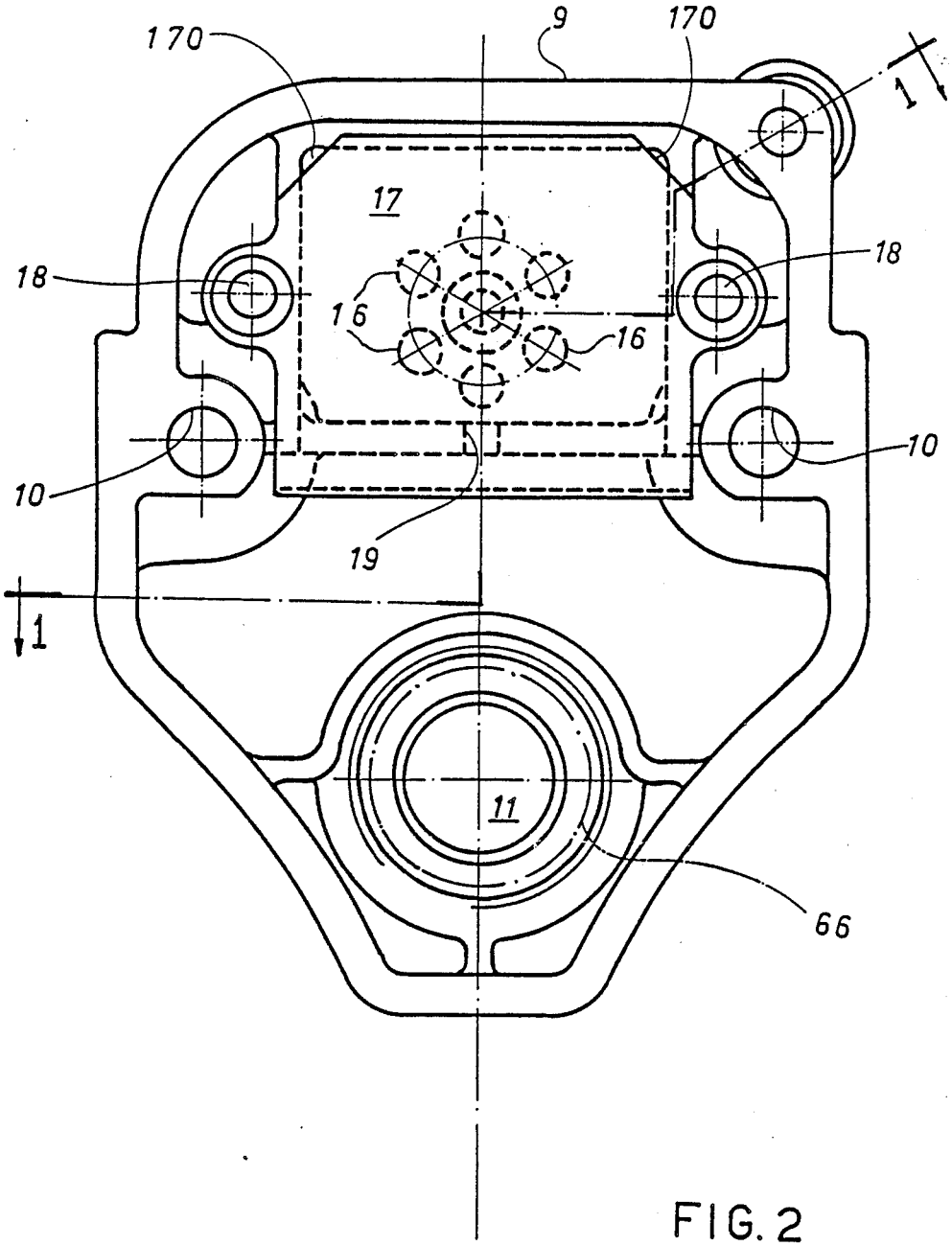
FIG. 2 is a view of the cover taken from below.

The engine crankcase, and thus the zone containing the lubricating oil, communicates with the top of the cylinder head 1 by way of the aperture in which said push rods are contained, this aperture being located in correspondence with the aperture indicated diagrammatically at 66 in FIG. 2. As is usual, a hollow shaped cover 9 is placed on the top of the cylinder head 1 to close the compartment containing said rockers 6 and the upper mouth of the aperture 66 (FIG. 2). The cover 9 is provided with holes 10 for fixing it to the cylinder head 1 (see FIG. 2) and a cap 11 is positioned on the aperture 66 to allow lubricating oil to be fed into the engine crankcase.

In addition, cover 9 comprises a duct system which connects the inner space of the cover 9 to a bore 13 (FIG. 1) which opens into the air intake manifold 2. The duct system comprises a first chamber 14 situated within the cover 9, and a second chamber 15 situated external thereto, said chambers being connected together by a circumferential series of equidistant holes 16 (FIG. 2). The first chamber 14 is closed by a base 17 fixed at 18 (FIG. 2), and communicates with the interior of the cover 9 through a side aperture 19 and two opposing end openings 170.

Furthermore, in said first chamber 14 there is housed a filtering layer 20 covering the passageways through said aperture 19 and said openings 170. The second chamber 15 is closed by a plate 21 which is fixed to the cover 9 at 22 and comprises a central stem 23 which acts a travel limiter for the lifting of a disc valve 24 which simply rests against the upper mouths of the holes 16.

The chamber 15 opens by way of a duct 240 into a cylindrical housing 25 which is aligned with said bore 13 and contains as a free sliding fit a piston 26 which lies between two springs 27 and 28. When in the operating position shown in FIG. 1, the piston 26 is completely raised and keeps the upper spring 27 compressed by the effect of the thrust produced by the lower spring 28.

When in said raised position, the piston is completely free of the communication port between the duct 240 and the housing 25. The space containing the spring 27 opens to the outside through a hole 29 provided in the plate 21. It should also be noted that the two springs 27 and 28 are sized such that the piston 26 is urged upwards with a force sufficient to oppose the lowering of the piston when there is the usual vacuum in the intake manifold 2, i.e., a vacuum derived from normal engine operation. More specifically, the piston 26 is subjected to a thrust which is at least slightly less than the force in the opposite direction which would act on said piston if in the intake manifold 2 a vacuum was created sufficient to draw lubricating oil up from the engine crankcase. This will be apparent hereinafter.

Finally, returning to FIG. 1 it can be seen that the lower spring 28 rests against a shoulder 30 which is provided at the lower end of the housing 25 to act as the valve seat for a valving member 31, this latter consisting of a push rod fixed to the piston 26.

During normal or regular engine operation the piston 26 remains raised by the spring 28, and the vapor due to the heating of the lubricating oil reaches the cover 9, facilitated by the effect of the vacuum induced in it via the duct system communicating with the intake manifold 2. That part of the vapor which condenses within the cover 9 returns to the crankcase through the aperture opposite the aperture 66, whereas the remainder flows toward the air intake manifold 2 after passing through the filtering layer 20. This latter retains most of the droplets transported in the passing flow, so that they combine into a fluid mass which is then discharged through the openings 170 (FIG. 2) to return to the engine crankcase.

The invention operates as stated while the vacuum within the air intake manifold 2 and thus in the housing 25 is of a value lying within the range for normal engine operation. In contrast, if for example because of clogging of the air filter there occurs in the manifold 2 a considerable vacuum of such a value as to suck lubricating oil up from to crankcase, the piston 26 lowers to interrupt communication between the duct 240 and the housing 25, the valving member 31 resting against the seat 30 to prevent said sucking action.

Under these operating conditions, the oil vapour present in the crankcase still escapes to the outside through the duct 240 and the hole 29, thereby allowing the engine to operate.

The invention is not limited to the single embodiment illustrated and described, but includes all technical equivalents of the described means and their combinations if implemented within the context of the following claims.

I claim:

1. A cover for a valve rocker compartment of an internal combustion engine, of the type consisting of a hollow shaped casing for housing rockers which operate the engine intake and exhaust valves, which comprises a duct system communicating with the air intake manifold and intercepted by a valving member which is elastically urged towards its open position with a force which exceeds the maximum pulling force exerted on the valving member by the vacuum in the manifold during normal engine operation, but which is less than the pulling force exerted on said valving member by a vacuum of such a vale as to draw up lubricating oil from the crankcase.

2. The cover as claimed in claim 1, wherein said valving member is fixed to a piston slidingly housed in a cylindrical seat which is provided with a valve seat for the valving member and has one end connected to the outside environment, whereas its other end communicates with said duct system and houses an elastic thrust member of predetermined load for said piston.

3. The cover according to claims 1 and 2, wherein said duct system comprises, upstream of said valving member, a chamber containing a filtering layer and provided with at least one opening to allow the oil retained by said layer to drain.

4. The cover according to claim 3, wherein between said filter chamber and said valving member there is provided a disc valve, the valve seat of which is situated on the same side as said chamber.

* * * * *